US008746662B2

(12) United States Patent
Poppe

(10) Patent No.: US 8,746,662 B2
(45) Date of Patent: Jun. 10, 2014

(54) FOAM SPRING FOR PILLOWS, CUSHIONS, MATTRESSES OR THE LIKE AND METHOD FOR MANUFACTURING SUCH A FOAM SPRING

(75) Inventor: Willy Poppe, Sint-Niklaas (BE)

(73) Assignee: Elisna S.A.R.L., Luxembourg (LU)

( * ) Notice: Subject to any disclaimer, the term of this patent is extended or adjusted under 35 U.S.C. 154(b) by 204 days.

(21) Appl. No.: 11/975,931

(22) Filed: Oct. 23, 2007

(65) Prior Publication Data

US 2009/0100603 A1 Apr. 23, 2009

(51) Int. Cl.
*A47C 27/15* (2006.01)
*F16F 1/37* (2006.01)

(52) U.S. Cl.
USPC ..... 267/142; 5/719; 5/740

(58) Field of Classification Search
USPC ..... 267/142–146, 152; 5/655.9, 718, 719, 5/740
See application file for complete search history.

(56) References Cited

U.S. PATENT DOCUMENTS

| | | | | |
|---|---|---|---|---|
| 2004/0025256 | A1 * | 2/2004 | Mossbeck | 5/655.8 |
| 2005/0084667 | A1 * | 4/2005 | Landvik et al. | 428/316.6 |
| 2005/0172468 | A1 | 8/2005 | Poppe | 29/91.1 |
| 2006/0282954 | A1 | 12/2006 | Poppe | 5/720 |
| 2006/0288491 | A1 * | 12/2006 | Mikkelsen et al. | 5/740 |
| 2008/0093784 | A1 * | 4/2008 | Rawls-Meehan | 267/80 |

FOREIGN PATENT DOCUMENTS

| | | | |
|---|---|---|---|
| BE | 878380 | | 2/1980 |
| BE | 1011070 | A3 | 4/1999 |
| EP | 0 624 332 | A1 | 11/1994 |
| EP | 0 762 011 | A1 | 3/1997 |
| EP | 0 793 932 | A1 | 9/1997 |
| EP | 793932 | A1 * | 9/1997 |
| EP | 0 872 198 | A2 | 10/1998 |
| EP | 1 046 365 | A1 | 10/2000 |
| WO | WO 2005/020761 | A1 | 3/2005 |
| WO | WO 2005/074752 | A1 | 8/2005 |
| WO | WO 2007/003018 | A1 | 1/2007 |

* cited by examiner

*Primary Examiner* — Anna Momper

(74) *Attorney, Agent, or Firm* — Mitchell P. Brook; McKenna Long & Aldridge LLP

(57) ABSTRACT

A foam spring for use in pillows, cushions, mattresses or the like, the foam spring having a tubular resilient body-made of foam with holes extending inwardly from an outside surface to an inside surface, wherein the tubular body-comprises at least one tubular foam layer and at least one reinforcing layer applied to said foam layer over at least a part of the axial length of the spring.

1 Claim, 4 Drawing Sheets

FOAM SPRING FOR PILLOWS, CUSHIONS, MATTRESSES OR THE LIKE AND METHOD FOR MANUFACTURING SUCH A FOAM SPRING

BACKGROUND OF THE INVENTION

1. Field of the Invention

The present invention concerns a foam spring, in particular a foam spring with a tubular resilient body made of foam with holes extending inwardly from the outside and which can be applied in the core of pillows, mattresses, armchair cushions or the like.

The invention also concerns a method of manufacturing such a foam spring.

2. Discussion of the Related Art

Such foam springs are known, for example, from U.S. Published Patent Application No. 2005/172468 and European Patent Document No. 0 872 198, disclosing a foam spring made of a foam layer strip of, for example, latex or polyurethane foam, provided with slits, whereby the strip is bent and two opposite ends of the strip are glued together to form a hollow tubular body with diamond shaped holes formed by stretching the slits in a lateral direction due to the bending of the strip.

Although known foam springs are very much valued by the users of the pillows, mattresses or the like, they have a disadvantage that they are not suitable for use by persons with varying weights.

For example, when a mattress is provided with foam springs having a very low stiffness, such a mattress will be soft and will probably be suitable for a person which is not heavy.

However, when the same mattress is used by a heavy person, the mattress is expected to compress too much so that the person will sink into the mattress and is actually supported by the harder surfaces underneath the mattress, such as the wooden structures of a bed, etc.

A heavier person would therefore use a firmer mattress and a lighter person a softer mattress, but it is not always realizable to adapt the mattress to the person who will use it, as for example in hotels, etc.

Another example is that of a mattress of a double bedstead, which is aimed to be used by two persons at the same time, who usually have a different weight.

If such a mattress is equipped with the known foam springs, the compression of the mattress is often considerably greater at the side of the heaviest person, causing discomfort.

Another drawback of the known foam springs is that the required stiffness of the spring determines a person's feeling at the contact surface with the spring.

In other words, a spring that compresses easily results in a soft contact surface feeling, while a spring that is more stiff will result in a harder contact surface feeling.

However, in some more dynamic situations a spring is required that is very soft in order to absorb and damp certain vibrations, while it is better for the comfort of the user to have a rather hard contact surface, as for example in mattresses and cushions used in certain vehicles.

SUMMARY OF THE INVENTION

It is an object of the present invention to provide a foam spring with improved properties for use in pillows, cushions, mattresses or the like.

To this end the invention concerns a foam spring having a tubular resilient body made of foam with holes extending inwardly from an outside surface to an inside surface, wherein the tubular body is composed of multiple foam layers, whereby at least a first tubular foam layer and a second tubular foam layer have differing physical characteristics, the first and second foam layers being axially superposed to one another.

By axially superposing foam layers of different kinds of foam, according to the invention a foam spring is obtained with a non-linear compression characteristic.

Indeed, in a known homogeneous spring composed of only one kind of foam, the amount of compression a spring will experience, is roughly directly proportional to the amount of force or weight that is applied on the spring, at least within certain limits.

In a spring having different axially superposed foam layers, as in the present invention, the softest foam layer or layers will compress easily, while it will be more difficult to compress the harder layer or layers.

When a force applied on such a multiple foam layer spring is continuously augmented, at a certain stage the softest foam layer or layers will be completely compressed, so that they do not contribute any further in the amount of compression of the spring.

Thus, the more the spring is compressed, the more the spring will resist to further compression, which is the characteristic of a strain hardening spring.

A first advantage of such a foam spring according to the invention is that it is particularly adapted for application in pillows, cushions, mattresses or the like, used by persons of varying weights, since such a foam spring has the property to compress sufficiently under a small weight, while it resists to further compression when it is subjected to heavier weights, so that enough support is always provided.

Another advantage of such a spring according to the invention is that it is possible to separate the characteristic the spring has at the contact with the user from the actual compression characteristic of the spring.

For example, when the user is in contact with a rather small more resilient foam layer which is on top of a broader, more stiff foam layer, the user will have a comfortable soft feeling while the actual compression of the spring is small.

The opposite is evidently also possible.

According to a preferred embodiment, the tubular body is composed of three tubular foam layers superposed with respect to one another, for example, with one of the first and second foam layers axially interposed between an additional third foam layer and the other of said first and second foam layer.

Preferably, said foam layers at both sides of the axially interposed layer are made of the same kind of foam.

An advantage of such a foam spring is that it can be made symmetrical so that it makes no difference which side of the foam spring is used.

The invention also concerns a method for manufacturing a foam spring as described before, which method is mainly comprised of cutting a rectangular strip from a foam section having multiple bands of different foam interconnected to one another along a longitudinal direction, the rectangular strip being cut through the different bands along a direction transverse to their longitudinal direction; the length and the height of the strip corresponding respectively to the required circumference and height of the tubular body; bending the two opposite ends of the strip lying along the longitudinal direction of the bands towards each other and fixing these two opposite ends of the strip into a tubular shape in order to form the tubular resilient body. In this manner, the multiple foam bands form foam layers in the tubular resilient body which are axially superposed with respect to one another.

An advantage of such a method is that it allows foam springs to be produced in accordance with the present invention in a very easy way and in big quantities.

The method is also very suitable for automated applications.

BRIEF DESCRIPTION OF THE DRAWINGS

In order to better explain the characteristics of the invention, the following preferred embodiment of a foam spring and of a method according to the invention for manufacturing such a foam spring is described as an example only, without being limitative in any way, with reference to the accompanying drawings, in which.

DESCRIPTION OF THE PREFERRED EMBODIMENT

Figure 1:
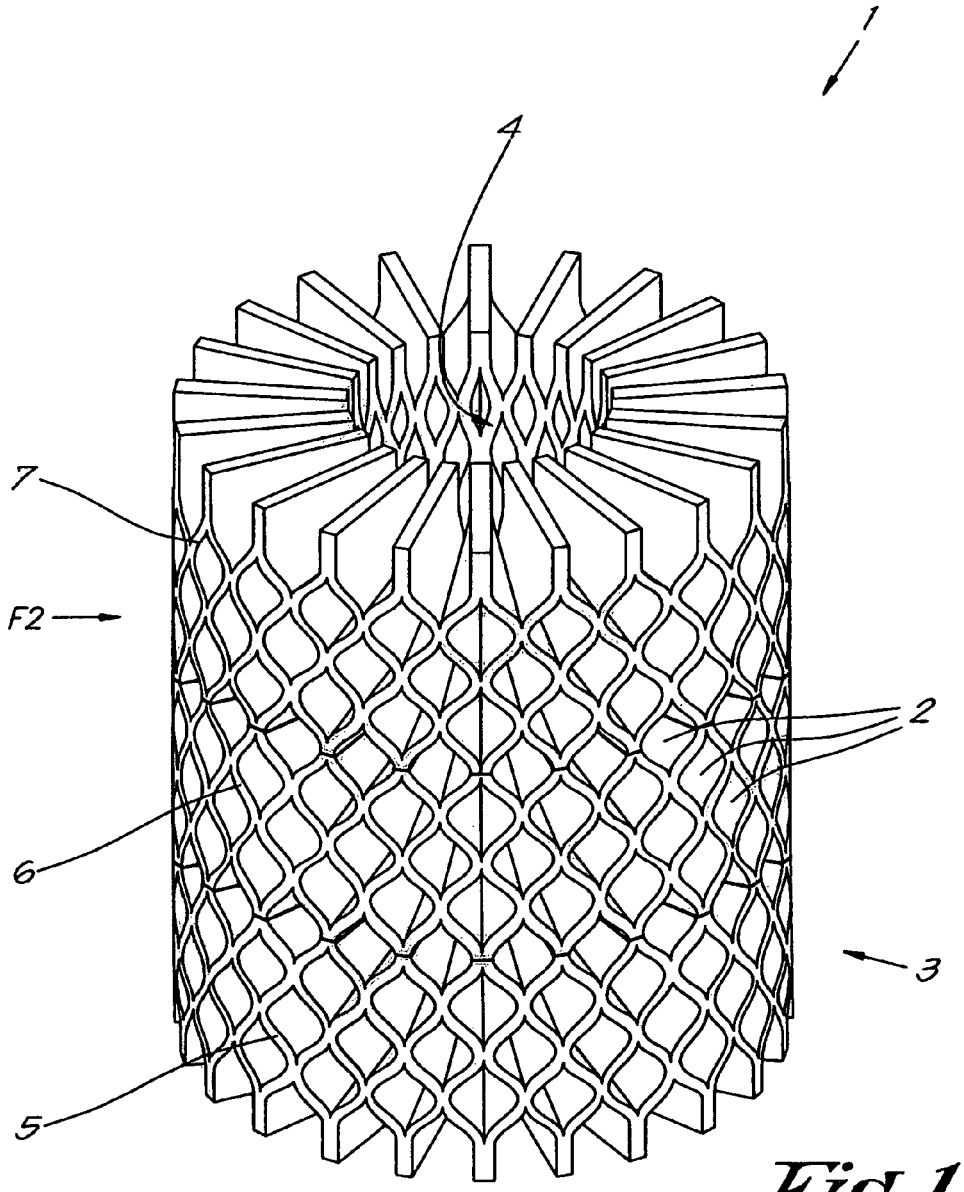
FIG. 1 represents a schematic perspective view of a foam spring according to the invention.

The foam spring 1 represented in FIG. 1 is a foam spring in accordance with the present invention for use in pillows, cushions, mattresses or the like.

The foam spring 1 has a tubular resilient body made of foam with holes 2 extending inwardly from an outside surface 3 to an inside surface 4.

Characteristic to the foam spring 1 is that the tubular body is composed of multiple foam layers 5, 6 and 7, whereby at least a first tubular foam layer 5 and a second tubular foam layer 6 are made of a different kind of foam, the first foam layer 5 and the second foam layer 6 being axially superposed with respect to one another.

In the representative case of FIG. 1, the tubular body is composed of three tubular foam layers 5, 6 and 7, whereby the second foam layer 6 is axially interposed between the third foam layer 7 and the first foam layer 5.

In this particular example the foam layers 5 and 7 that surround the axially interposed layer 6 are made of the same kind of foam.

Figure 2:
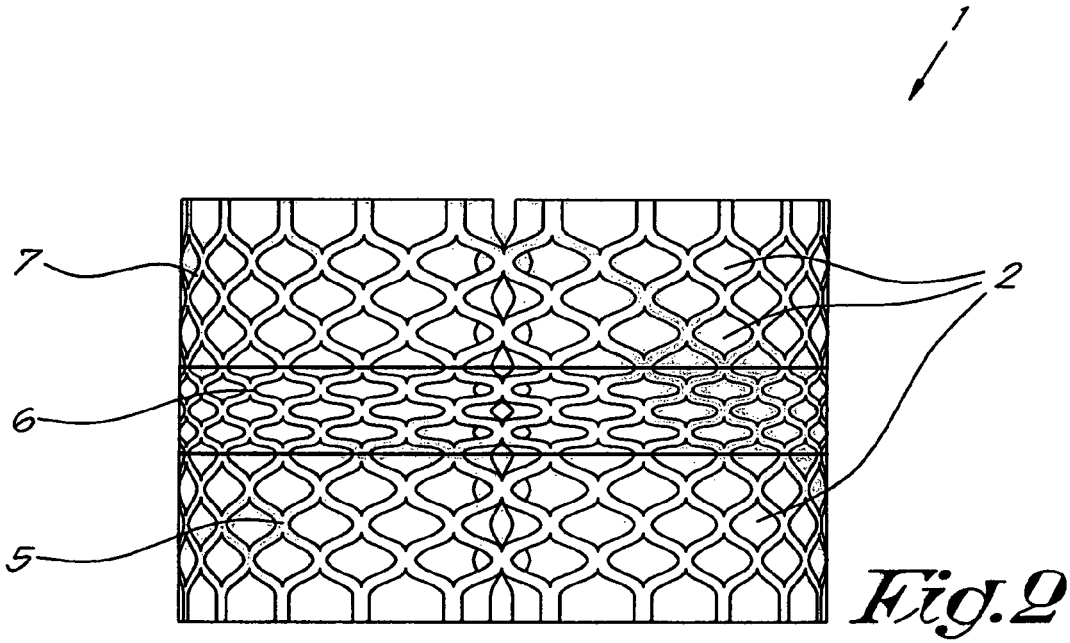
FIG. 2 is a side-view according to arrow F2 in FIG. 1.

As is more clearly shown in the view of FIG. 2, in this example the second foam layer 6 is made of a foam with smaller holes 2 so that it has a higher density than the first foam layer 5 and thus also a higher density than the third foam layer 7, which is made of the same foam as foam layer 5.

However, it is not excluded according to the invention to make a foam spring 1 wherein the second foam layer 6 has a lower density than the other two foam layers 5 and 7.

Furthermore, the second foam-layer 6 is more resilient than the first foam layer 5 and the third foam layer 7.

The different foam layers 5, 6 and 7 can be interconnected by gluing.

Also embodiments whereby the foam layers 5, 6 and 7 are for example interconnected by means of a heating process or directly during the production of the foam are not excluded.

On the other hand some of the layers may not be interconnected at all.

It is also possible that the tubular body is composed of more than three foam layers which are axially superposed with respect to one another.

It is clear that such a foam spring 1 has a compression characteristic of a strain hardening spring, since the more force to the spring is applied, the more difficult it will be to compress the spring any further, as was described in the introduction.

Therefore, such a foam spring 1 in accordance with the present invention is very useful for cushions, pillows and/or mattresses which are used by people with varying weights, which is one of the objectives of the present invention.

Figure 3:
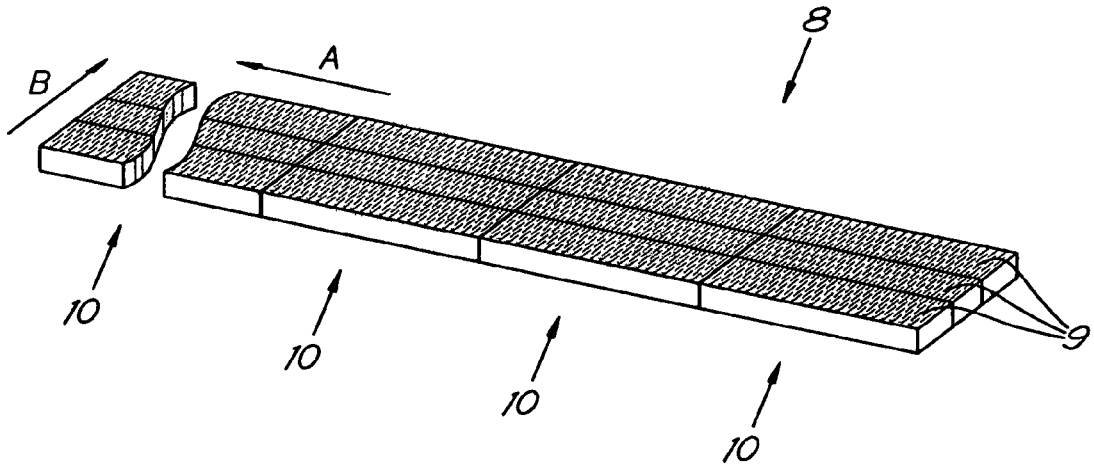
FIGS. 3 to 5 illustrate different steps of a method for manufacturing a foam spring in accordance with the present invention whereby a foam layer having multiple bands of different foam interconnected to one another along a longitudinal direction is used.
Figure 4:
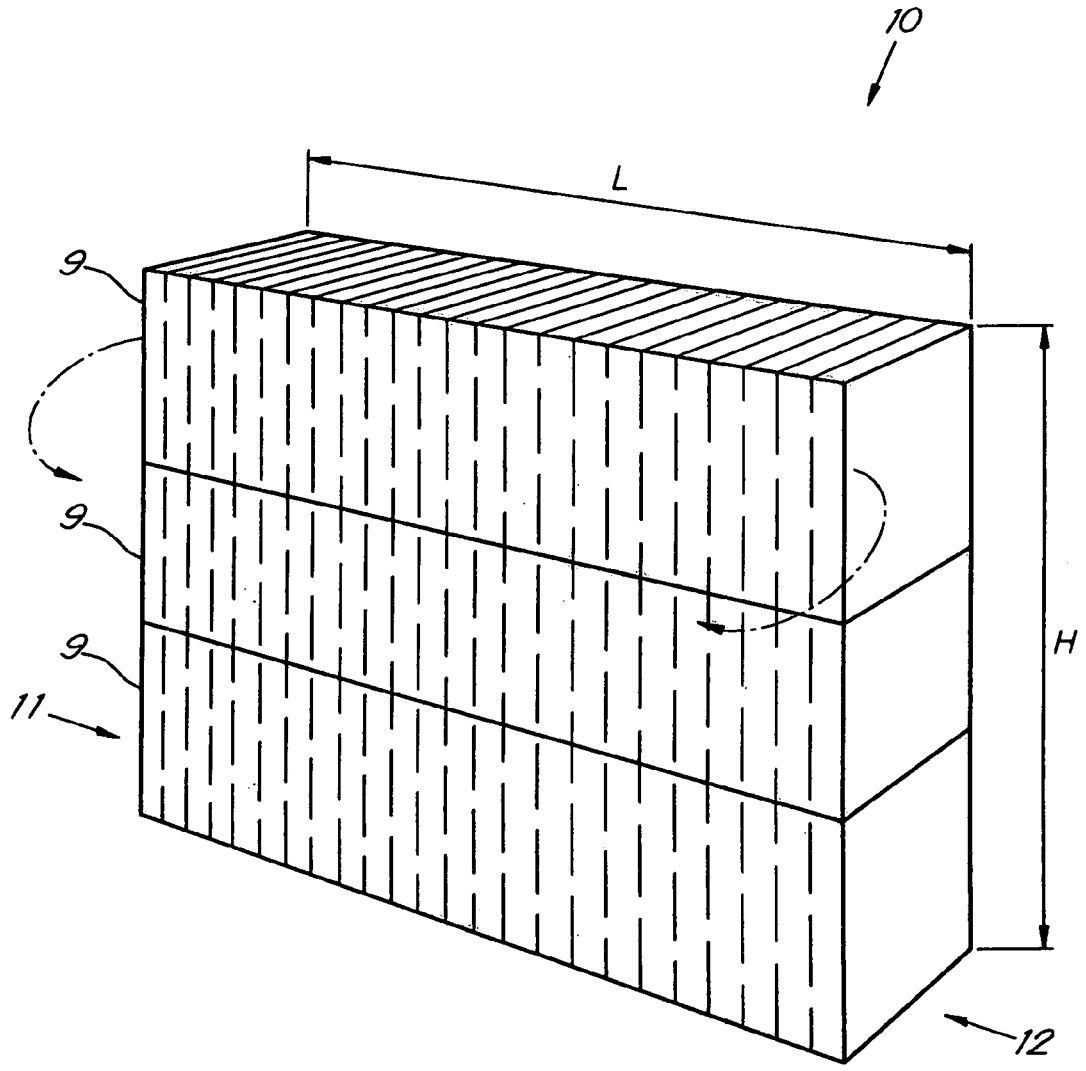
Figure 5:
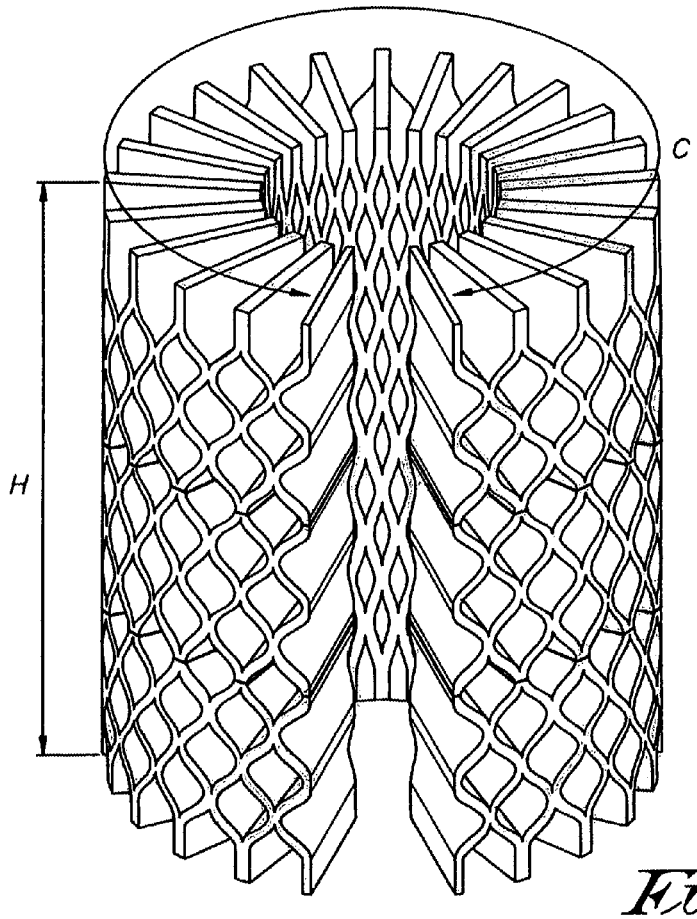

FIGS. 3 to 5 illustrate different steps of a preferred method for manufacturing a foam spring 1 in accordance with the present invention.

In this method a foam section 8 is used, as represented in FIG. 3, which has multiple foam bands 9 of different physical characteristics interconnected to one another along a longitudinal direction A.

In a first step of the method a rectangular strip 10 is cut from the multiple band foam section 8, represented in FIG. 4, through the different bands 9 along a direction B transverse to the longitudinal direction A.

The length L and the height H of the rectangular strip 10 correspond respectively to the required circumference C and height H of the tubular body to be obtained.

In a second step, which is represented in FIG. 5, this rectangular strip 10 is bent with its two opposite ends 11 and 12 lying along the longitudinal direction A of the bands 9 towards each other.

Then these two opposite ends 11 and 12 of the rectangular strip are fixed into a tubular shape in order to form the tubular resilient body.

The opposite ends 11 and 12 are preferably glued to one another, although other methods of attachment or securement are not excluded from the invention.

The present invention is by no means limited to the above-described embodiments given as an example and represented in the accompanying drawings; on the contrary, such a foam spring and method for manufacturing such a spring can vary while still remaining within the scope of the invention.

In view of the aforesaid written description of the present invention, it will be readily understood by those persons skilled in the art that the present invention is susceptible of broad utility and application. Many embodiments and adaptations of the present invention other than those herein described, as well as many variations, modifications, and equivalent arrangements, will be apparent from or reasonably suggested by the present invention and the foregoing description thereof, without departing from the substance or scope of the present invention. Accordingly, while the present invention has been described herein in detail in relation to preferred embodiments, it is to be understood that this disclosure is only illustrative and exemplary of the present invention and is made merely for purposes of providing a full and enabling disclosure of the invention. The foregoing disclosure is not intended nor is to be construed to limit the present invention or otherwise to exclude any such other embodiments, adaptations, variations, modifications and equivalent arrangements, the present invention being limited only by the claims appended hereto and the equivalents thereof.

What is claimed is:

1. A method for manufacturing a foam spring with a tubular, resilient body for use in pillows, cushions or mattresses, which method comprises cutting a rectangular strip from a foam section having multiple discrete bands of foam interconnected to one another along a longitudinal direction, the multiple foam bands being made of foam materials of differing material compositions which impart different physical characteristics to the respective multiple bands, the rectangular strip being cut through the different bands along a direction transverse to their longitudinal direction; the length and the height of the strip corresponding respectively to the required circumference and height of the tubular body; bending the two opposite ends of the strip lying along the longitudinal direction of the bands towards each other and fixing these two opposite ends of the strip into a tubular shape in order to form the tubular resilient body such that the multiple foam bands form foam layers of differing material compositions with different physical spring characteristics which are axially superposed with respect to one another to contribute differing spring characteristics to the foam spring, wherein the differing foam material compositions are selected in relation to one another to achieve in combination a predetermined overall spring performance in the foam spring.

* * * * *